United States Patent [19]

Brown

[11] Patent Number: 4,893,705

[45] Date of Patent: Jan. 16, 1990

[54] VENDING MACHINE HAVING PLURAL COMPARTMENTS WHICH ARE INDEPENDENTLY SELECTED AND CONTROLLED

[76] Inventor: Leonard C. Brown, Penthouse, Warner Doone Flats, Warner Beach, Durban, Natal, South Africa

[21] Appl. No.: 206,225

[22] Filed: Aug. 1, 1988

Related U.S. Application Data

[60] Division of Ser. No. 129,967, Dec. 4, 1987, abandoned, which is a continuation-in-part of Ser. No. 745,115, Jun. 17, 1985, abandoned.

[51] Int. Cl.[4] ..... G07F 7/02

[52] U.S. Cl. ..... 194/211; 194/214; 194/350; 235/381

[58] Field of Search ..... 221/4, 5, 6, 12, 69, 221/92, 134, 154, 155, 306; 194/205, 208, 210, 211, 212, 213, 214, 350; 235/381, 383, 385; 312/35, 215; 364/479; 340/545, 568, 570, 825.35

[56] References Cited

U.S. PATENT DOCUMENTS 3,884,386 5/1975 Urcola ..... 221/7
4,636,634 1/1987 Harper et al. ..... 235/385 X

FOREIGN PATENT DOCUMENTS 3336619 4/1985 Fed. Rep. of Germany ..... 194/205
2254071 7/1975 France ..... 221/155

*Primary Examiner*—Joseph J. Rolla
*Assistant Examiner*—Edward S. Ammeen

[57] ABSTRACT

An electronically controlled dispensing machine for articles such as video cassettes has a plurality of individual lockable compartments. The compartments have transparent doors through which the articles can be identified. A customer presents a coded data storage token with a credit amount stored on it to the machine, and selects and removes one of more articles. The machine reduces the credit amount on the token accordingly. The articles can be returned to a vacant compartment in due course, and if the article is returned late, a further amount is deducted from the credit amount on the token. Sensors in each compartment ensure that the cassettes are inserted correctly by sensing an electrically conductive portion of the cassettes.

8 Claims, 3 Drawing Sheets

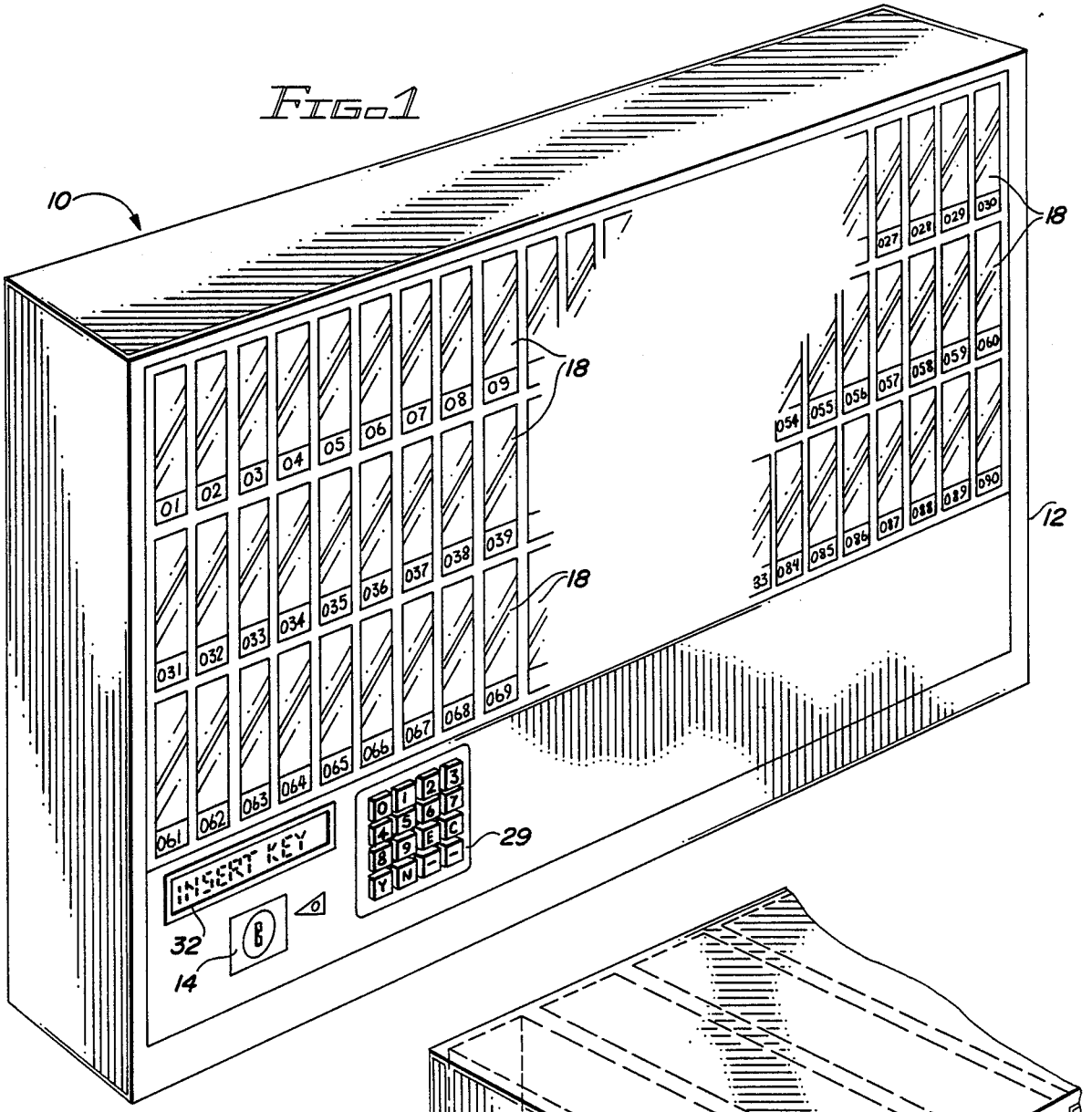
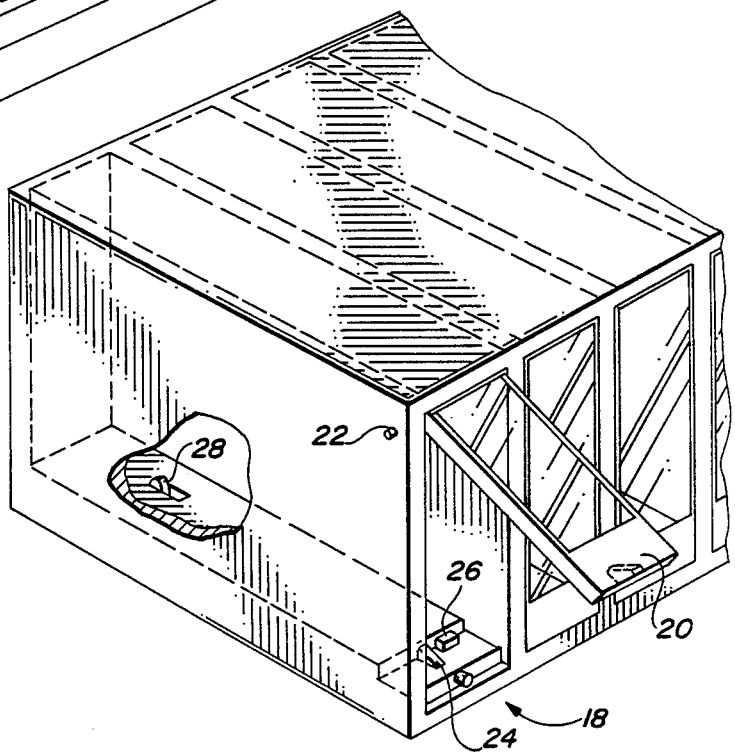
FIG. 2
FIG. 3

VENDING MACHINE HAVING PLURAL COMPARTMENTS WHICH ARE INDEPENDENTLY SELECTED AND CONTROLLED

This application is a divisional of application Ser. No. 129,967, on Dec. 4, 1987 now abandoned, which application was in turn a continuation-in-part of application Ser. No. 745,115 filed June 17, 1985, now abandoned.

BACKGROUND OF THE INVENTION

This invention relates to a dispensing machine and in particular to a machine adapted for dispensing video cassettes intended to be used by borrowers using the services of a particular video outlet.

Vending machines are well known in the prior art, these generally being of the coin-operated type in which the user of the machine inserts a coin to receive a commodity such as a pack of cigarettes, cool drinks or the like. Also well known in the prior art is the new electronic banking system where a client of a particular bank inserts a card which actuates a device to deliver a predetermined or chosen amount of money. Documented prior art of which the applicant is aware includes the following:

U.S. Pat. No. 4,179,064 (Yoshioka et al) discloses a memory holder insertable in an opening of a vending machine. On selection of the appropriate buttons merchandise is discharged from an opening and the information concerning the selected merchandise is transmitted to the memory holder which readable by an accounting machine which computes the value of the merchandise.

In U.S. Pat. Nos. 4,297,569 and 4,436,993 (Flies) data storage devices shaped as keys are described. These key devices store information which is readable by the device into which the keys are inserted, and are also capable of taking in new information. U.S. Pat. No. 4,458,802 (McIver et al) discloses a method and apparatus for renting video cassettes . A token presented by a customer is retained by the apparatus until the rented cassettes are returned. Alternatively, an accounting system which may be linked to a central computer is envisaged for use with this apparatus. The apparatus comprises a carousel mechanism with a number of compartments, each of which holds a video cassette. The cassettes bear an individual code and when a cassette is returned, the apparatus reads the code and identifies the cassette before returning it to its own particular compartment.

U.S. Pat. Nos. 4,414,467 and 4,300,040 (Gould et al) describe video cassette vending machines in which a terminal enables a card holder to preview cassettes prior to ordering a cassette.

U.S. Pat. No. 4,020,326 (Coulthurst) describes token control equipment in which information about use of a token is recorded. The recorded information is continually updated to keep track of use of the token.

SUMMARY OF THE INVENTION

According to the invention there is provided an apparatus for dispensing articles which comprises a plurality of compartments for storing the articles, each compartment having an electronically-controlled lockable door and at least part of an article stored in any compartment being visible from outside the compartment; article sensor means in each compartment comprising electrodes arranged to sense the presence of an electrically conductive portion of an article which has been correctly inserted into the compartment; control means for selectively unlocking the compartments in response to control signals; means for accepting and reading a token presented by a user of the apparatus, the token having a memory element; selection means for selecting a desired article; and processing means for providing control signals to the control means in order to unlock the door of a compartment containing an article selected by use of the selection means and for transferring information to and from the token, the user removing the selected article from the unlocked compartment, and information relating to the dispensing transaction being stored by the token.

BRIEF DESCRIPTION OF THE DRAWINGS

An embodiment of the invention is described by way of example with reference to the accompanying drawings in which:

FIG. 1 is a front view of a video cassette dispensing machine according to the invention;

FIG. 2 is a perspective view of a compartment of the cabinet of FIG. 1;

FIG. 3 is a perspective view of a data storage token or key suitable for use with the dispensing machine of FIG. 1;

DESCRIPTION OF A PREFERRED EMBODIMENT

Figure 4:
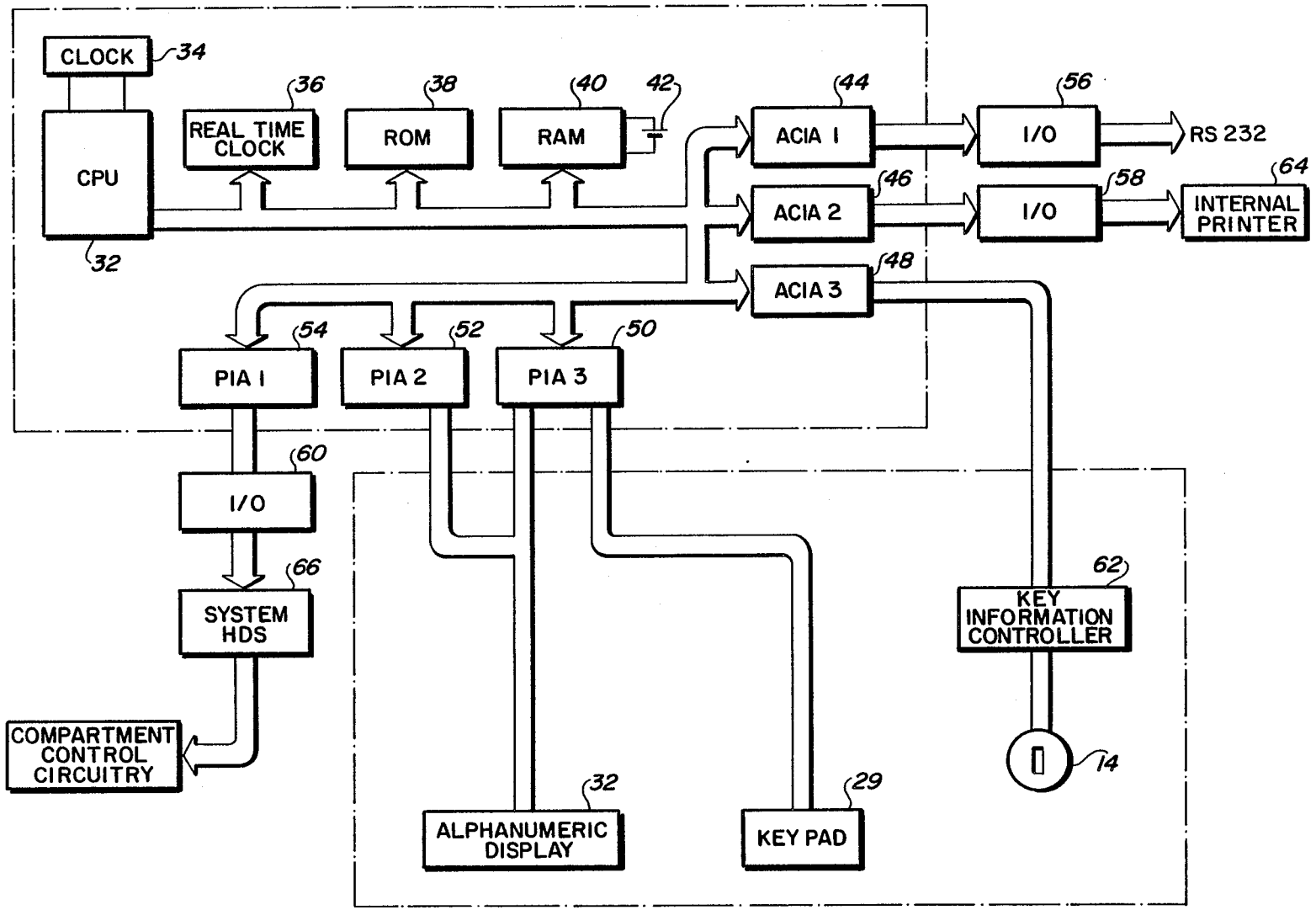
FIG. 4 is a block diagram of electronic processing circuitry for the machine of FIG. 1.

Referring to the drawings a video cassette vending machine 10 comprises a free standing cabinet 12 having a key reader with an insertion aperture 14 for receiving a data storage token or key 16.

The cabinet 12 has an upper section divided into a plurality of compartments 18 which are arranged in vertical and horizontal rows. As seen in FIG. 2 each compartment 18 has a transparent door 20 which is hinged at a hinge pin 22 and adapted to be locked and unlocked by a solenoid-operated latch 24. Two sensor devices 26 and 28 are provided to sense the opening and closing of the door 20 and the presence of a cassette respectively. The sensor 26 is conveniently a microswitch which is mounted adjacent the door 20 so that closing of the door opens the switch contacts and opening of the door closes the contacts. The sensor 28 comprises a pair of spaced electrical contacts at one side of the compartment 18. The contacts can be spring-loaded and project into the compartment. A lower section of the cabinet houses the key-receiving aperture 14 and a keypad 29. Adjacent the keypad 29 on the front panel of the cabinet 12 is an alphanumeric display 32 which provides information to prompt a user of the vending machine.

The key receiving aperture 14 is provided with contacts which make contact with complementary contacts on the shank of the key 16 and which connect an electronic memory element in the key 16 to a microprocessor-based processing circuit 30 (Figure 4). The processing circuit 30 is provided on a single circuit board and includes a central processing unit (CPU) 32 with a clock 34, a calendar chip 36, a read only memory (ROM) 38, a random access memory (RAM) 40 with a back-up battery 42, three serial ports 44, 46 and 48, and three parallel ports 50, 52 and 54. The CPU 32 may be Motorola 6809, the calendar 36 may be a Motorola 146818, the ROM 38 may be an Intel 2764, the RAM 40 may be an Intel 6264, the serial ports 44, 46 and 48 may be Motorola 6820's, and the parallel ports 50, 52 and 54 may be Motorola 6850's.

Three input/output (I/O) interfaces 56, 58 and 60 connect the processing circuit 30 to an optional RS 232-compatible apparatus, an internal printer 64 and the circuitry controlling the individual compartments 18, respectively.

The alpha-numeric display 32 on the fascia of the machine is connected to the processing circuit 30 via the parallel ports 50 and 52, while the key pad 29 is connected to the processing circuit 30 via the parallel port 50. The port 50 is shared by the key pad and the display. The key receiving aperture 14 is associated with a key information controller unit 62, which is connected to the processing circuit 30 via the serial port 48. The key information may be a "KEYTROLLER" Model KT 1400 made by Datakey Inc.

Figure 5:
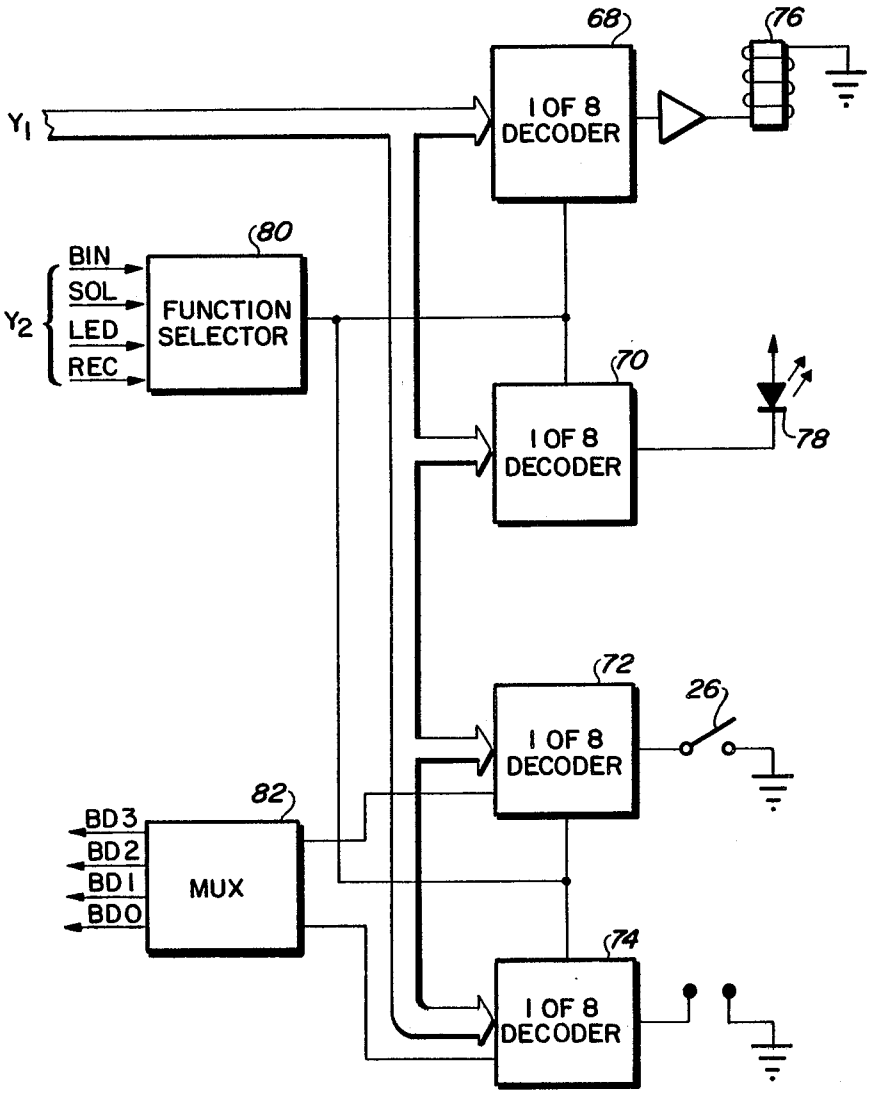
FIG. 5 is a block diagram of an electronic control circuit for a compartment of the machine of FIG. 1.

FIG. 5 shows electronic circuitry for controlling the video cassette compartments. The compartments 18 are grouped into "bins" of 8 compartments. FIG. 5 shows the circuitry for controlling one bin. The various components of a single compartment only are shown in FIG. 5, for clarity. The bin control circuit comprises four 1 of 8 decoders 68, 70, 72 and 74. The solenoids 76 of the door latches 24 are controlled by the decoder 68. LEDs 78 adjacent to each compartment door are controlled by the decoder 70. The state (open or closed) of the micro switch sensors 26 of each compartment is detected via the decoder 72, and the contacts of the cassette sensors 28 are monitored via the decoder 74. The decoders 68 and 70 are selected by a decoder 80, while the state of the sensors 26 and 28 is conveyed via a multiplexer 82 from the decoders 72 and 74.

Figure 6:
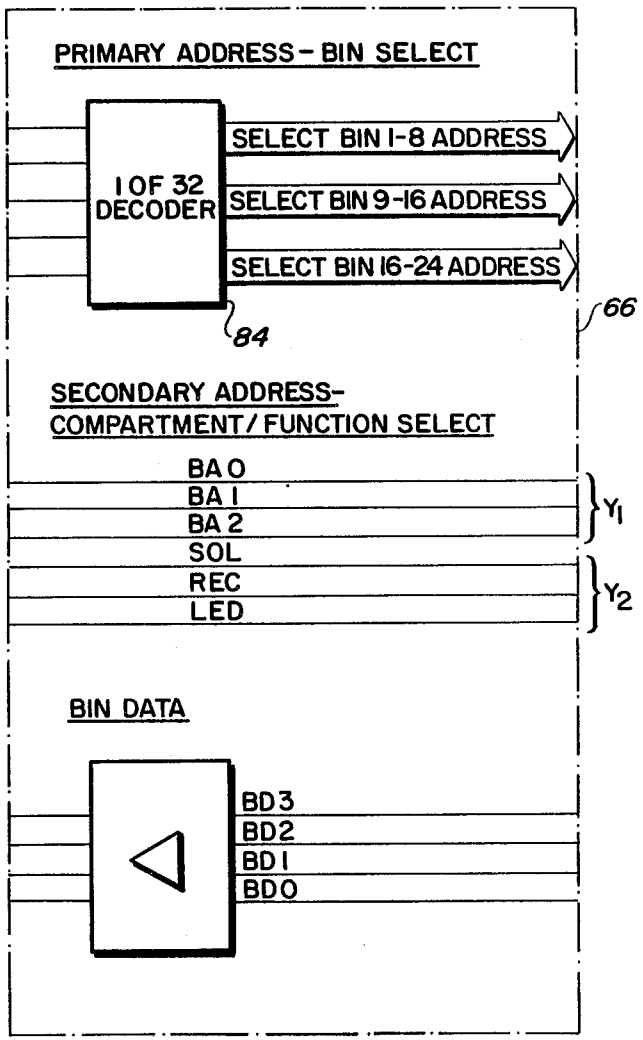
FIG. 6 is a diagram of a data bus between the compartments and the processing circuitry.

FIG. 6 shows the sixteen bit system bus 66 in greater detail. The bus carries carries primary address information, secondary address information and bin data information. Twenty-four bins (of eight compartments each) are provided, which are selected by means of a primary address via a 1 of 32 decoder 84. The output of the decoder 84 is split into selection lines for bins 1 to 8, 9 to 16 and 17 to 24. A secondary address allows one of the eight compartments in a selected bin to be selected. Part of the secondary address selects the solenoid, LED, or the sensors 26 and 28 of a selected compartment. Three bits, labelled $Y_1$, are required to select a particular compartment in a selected bin. Three further bits, $Y_2$, select the solenoid, the LED or the sensor 28 of the selected compartment. The data from the sensors 26 and 28 of each compartment is fed to the multiplexer 82, which requires four bits of the system bus to convey the information from the eight compartments of each bin.

The operation of the vending machine will now be described. Between vending transactions, the machine waits in an idle mode with the message "INSERT KEY AND TURN TO BEGIN TRANSACTION". The user inserts his key 16 into the key receiving aperture 14 and turns it clockwise. The machine will illuminate a "busy" light and displays the message "DO NOT REMOVE KEY WHILE BUSY LIGHT IS FLASHING". Encoded on the key is a vending machine identification number, a user personal identification number (PIN), and the number of transaction units remaining on the key. Once the key 16 has been inserted, the key information controller 62 reads the information from the key and transmits it via the serial port 48 to the processor circuit 30, interupting the CPU 32 and initiating the transaction. If the key is valid for the particular machine, that is, if the machine ID number on the key matches the number of the particular machine, the user will be prompted with the display "ENTER YOUR SECRET CODE NUMBER". The user enters his personal identification number (PIN), and the machine will then display the message "PLEASE WAIT MACHINE IS BUSY". The processor circuit compares the number entered with the number read from the key. If the numbers correspond, the machine will print on the internal printer 64 a transaction number, the identification number, the time, date and the number of transaction units remaining on the key.

The user will now be prompted to make a selection by displaying "ARE YOU SELECTING A VIDEO YES/NO". If "YES" is typed the machine will inform the user of the number of units remaining on the key and prompts the user to select a compartment number. The user can see the titles of the video cassettes through the transparent compartment doors and can select the number of a compartment corresponding to the video cassette he wishes to borrow. The user enters that number and the LED 78 adjacent that compartment will illuminate. The machine will verify that a cassette is in the selected compartment by means of the respective sensor 28. The solenoid 76 is then energised, opening the compartment door and allowing the user to remove the video cassette. the display prompts the user with "REMOVE THE VIDEO AND CLOSE PROPERLY". Once this has been done, the user is prompted with "ARE YOU RETURNING A VIDEO YES/NO". By pressing the "NO" button the user enters an exit routine and is allowed to remove the key after the number of transaction units remaining on the key has been decremented.

If the user wishes to return a video cassette, the machine will open an empty compartment and prompt the user to close the compartment door after the cassette has been inserted. If a video cassette is not returned timeously, the key 16 can either be debited accordingly at the next transaction, or invalidated entirely.

The operating program for the vending machine is contained in the ROM 38. The RAM 40 is used to store data temporarily during transactions.

Although a program operated vending machine has been described, it would be possible to simplify the operation of the machine by using only hard-wired electronic circuitry.

I claim:

1. Apparatus for dispensing video cassettes and other articles, comprising:

a cabinet having a plurality of compartments for storing and dispensing video cassettes and other articles, said cabinet arranged so that all of said plurality of compartments may be simultaneously viewed by a customer;

each compartment having an individual, visually transparent and lockable door panel;

first sensing means with each compartment for detecting the presence of an electrically conductive portion of a video cassette or other article which has been correctly inserted therein;

means with each compartment for independently controlling the opening of the corresponding compartment door panel;

second sensing means with each compartment for detecting when the corresponding compartment door panel is open;

compartment selection means operable by a customer for providing an electronic indication representative of a selected compartment;

means for providing an electronic indication representative of the receipt of a customer payment token for the video cassette or other article located in the selected compartment and for verifying the customer payment token;

means for retaining said customer payment token until the customer has properly closed the door panel to the selected compartment following removal of the video cassette or other article; and electronic circuit means for receiving inputs from said first and second sensing means, said compartment selection means and said customer payment indication means and for selectively operating said compartment door panel opening means for the selected compartment to open only that door panel and permit access by the customer only to the selected compartment, but only if a video cassette or other article having a correct electronically conductive portion is located therein as determined by said first sensing means and only if the door panel for said selected compartment is previously closed as determined by said second sensing means.

2. The apparatus recited in claim 1 wherein said second sensing means comprises a microswitch.

3. The apparatus recited in claim 2 wherein said first sensing means comprises an electronic sensor along an inside wall of each compartment.

4. The apparatus recited in claim 3 further comprising means responsive to a customer return input for opening an empty compartment as determined by said first sensing means, to permit the customer to return a video cassette or other article to the opened compartment.

5. The apparatus recited in claim 1 wherein each compartment door panel is hinged along one side thereof, and wherein said door panel opening means comprises a solenoidoperated release mechanism located along a second side of said door panel opposite said one side.

6. Apparatus for dispensing video cassettes and other articles, comprising:

a cabinet having a plurality of compartments for storing and dispensing video cassettes and other articles, said compartments arranged in said cabinet in rows and columns so that the video cassettes or other articles in all of said compartments may be perused simultaneously by a customer located in front of said cabinet;

each compartment having a separate visually transparent, outwardly-facing and lockable door panel along the front of said cabinet;

an electronic sensor located along an inside wall of each compartment for detecting the presence of a video cassette or other article which has been correctly inserted therein;

a solenoid located within each compartment for opening the corresponding door panel to permit access to the corresponding compartment responsive to an electrical input;

a microswitch with each compartment for detecting when the corresponding door panel is opened;

a keypad along the front face of said cabinet for receiving a customer input representative of a predetermined compartment selected by the customer, and for providing an electrical indication representative thereof;

an aperture along the front face of said cabinet and a related payment circuit associated with said aperture for receiving a customer payment token for the video cassette or other article located in said selected compartment and providing an electronic indication representative of payment;

an electronic signal processing circuit in said cabinet for receiving and processing inputs from said electronic sensor, said microswitch, said keypad and said payment circuit for selectively operating said compartment door panel solenoid for said selected compartment to only open that door panel and permit access by the customer only to said selected compartment, but only if a video cassette or other article is properly located therein as determined by said electronic sensor, and only if the door panel of said selected compartment is previously closed as determined by said microswitch; and means for retaining said customer payment token in said aperture after removal of the video cassette or other article from said selected compartment until the customer has properly closed the open door panel for said selected compartment, as determined by the microswitch at said selected compartment.

7. The apparatus recited in claim 6 further comprising means responsive to a customer return input for opening an empty compartment as determined by said electronic sensor to permit the customer to return a video cassette or other article to the opened compartment.

8. The apparatus recited in claim 7 further comprising circuit means for receiving said customer return input only upon receipt of said customer payment token into said aperture.

* * * * *